US010900180B2

(12) United States Patent
McO'Neil

(10) Patent No.: US 10,900,180 B2
(45) Date of Patent: Jan. 26, 2021

(54) COLLAPSIBLE SIGN

(71) Applicant: Barbara McO'Neil, Lancaster, CA (US)

(72) Inventor: Barbara McO'Neil, Lancaster, CA (US)

( * ) Notice: Subject to any disclaimer, the term of this patent is extended or adjusted under 35 U.S.C. 154(b) by 0 days.

(21) Appl. No.: 15/797,222

(22) Filed: Oct. 30, 2017

(65) Prior Publication Data

US 2018/0119372 A1 May 3, 2018

Related U.S. Application Data

(60) Provisional application No. 62/414,539, filed on Oct. 28, 2016.

(51) Int. Cl.

| | |
|---|---|
| ***E01F 9/646*** | (2016.01) |
| ***G09F 7/10*** | (2006.01) |
| ***G09F 15/00*** | (2006.01) |
| ***E01F 9/692*** | (2016.01) |
| ***E01F 9/654*** | (2016.01) |
| ***E01F 9/658*** | (2016.01) |

(52) U.S. Cl.

CPC ..... *E01F 9/646* (2016.02); *E01F 9/654* (2016.02); *E01F 9/658* (2016.02); *E01F 9/692* (2016.02); *G09F 7/10* (2013.01); *G09F 15/0062* (2013.01)

(58) Field of Classification Search

CPC ..... G09F 2007/1878
USPC ..... 40/610, 586
See application file for complete search history.

(56) References Cited

U.S. PATENT DOCUMENTS

| | | | | |
|---|---|---|---|---|
| 403,698 | A * | 5/1889 | Rector | G09F 21/02 40/586 |
| 2,655,749 | A * | 10/1953 | La Fontaine | G09F 7/00 40/604 |
| 4,572,510 | A * | 2/1986 | Green | G09F 21/02 273/148 R |
| 5,318,258 | A * | 6/1994 | Lang | E01F 9/688 248/166 |
| 2012/0204456 | A1 * | 8/2012 | Dobson | G09F 15/0062 40/610 |

* cited by examiner

*Primary Examiner* — Kristina N Junge
(74) *Attorney, Agent, or Firm* — Donn K. Harms

(57) ABSTRACT

A collapsible user customizable sign having a frame on a first end of a pole where the frame is moveable between a collapsed position to a deployed position. The frame has a plurality of removably engageable flexible panels having indicia thereon connected to distal ends of aligned horizontal members of the frame. The flexible panels may be changed to change the indicia and or the color of the flexible panels to provide a user a customizable portable sign.

8 Claims, 6 Drawing Sheets

FIG. 3

COLLAPSIBLE SIGN

This application claims priority to U.S. Provisional Patent Application Ser. No. 62/414,539, filed on Oct. 28, 2016, which is included herein in its entirety by this reference, thereto.

BACKGROUND OF THE INVENTION

1. Field of the Invention

The present invention relates generally to collapsible signs, such as a personalized sign created by users and/or warning signs, for example, signs employed for crosswalks or construction sites and the like to warn oncoming drivers of pedestrians such as children or workers being present, or signs used for sporting events or special events and the like. More particularly, the invention relates to a collapsible sign which may be personally customized with installed panels having both color and/or indicia for sporting events, special events, or for example, as a warning sign which is highly portable and collapsible to a small size, and which has indicia thereon on a plurality of planar viewable sides rendering the indicia, such as warnings, easy to read. The device is adapted for easy transition from a collapsed storage configuration, to an as-used position held above a user's head or having a ball end engaged with a pivoting mount.

2. Prior Art

Conventional pedestrian crosswalks are used throughout the world as designated pathways for pedestrians to cross a street traversed by vehicles. On road work construction areas, frequently workers will be working within inches of a vehicle lane. However, vehicle drivers are not always on alert for pedestrian traffic which may be crossing in front of their vehicle, or positioned adjacent the lane in which they are driving. This lack of pedestrian and worker awareness is exacerbated modernly because drivers are distracted by audio or video displays in their vehicles, cell phones, maps, and other distractions that abound in vehicles.

In addition, in many locations, crosswalks are not easily seen from a distance, and it is hard to ensure vehicular traffic is able to discern their presence. For example, painted stripes positioned on the surface of the pavement are difficult for drivers to see even under optimum circumstances. Crosswalk caution or warning signs, even when positioned proximately to the crosswalk, are easily visually lost in the background clutter of business signs, buildings, parked vehicles and trees and bushes. The same is true of temporary warnings concerning a temporary work site on the roadway, where such might not have been present hours before.

While some municipalities have installed street light warning systems and traffic signals to warn of crosswalk locations, such is not generally the case for most crosswalks. This is because such active warning devices tend to be extremely expensive to install and maintain. The same is true of temporary work sites on roadways because permanent installation of warning lights, is not cost effective.

In the case of crosswalks used by children, such as at schools and walkways leading thereto, the problem of adequate warning to approaching drivers is so they might take precautions is especially significant. This is because, unlike adult pedestrians who tend to be more aware of vehicles having become experienced at the danger of street crossing, children can be especially unaware of the danger they face from oncoming vehicles. Even if somewhat aware of such dangers, children are easily distracted.

As a remedy for pedestrian crossing, where children may be frequently present, many schools have older students or adults serve as crossing guards. Such generally has the student or adult dressed in bright clothing acting as a pedestrian traffic director for younger students. In many cases the crossing guard may place a sign in the street or wear one on their person.

The same is true of temporary road work sites, where small repairs are being addressed by a crew of workers. In such cases everyone is familiar with a lone worker holding a caution sign which may or may not be seen by approaching traffic.

Additionally, such street-level positioned signs are easily lost from the line of sight of drivers approaching a crosswalk, as are small signs crossing guards may position on their person. Larger and multi sided signs tend to be too heavy for crossing guards to carry and even if they are employed, they are generally left in a static position on the ground where oncoming drivers can easily miss viewing them.

The disclosed device herein provides a warning sign to alert oncoming drivers of pedestrians in the roadway, which can be easily elevated above the worker or crossing guard, to make it visible to oncoming drivers at a greater distance than static signs. So configured, the device herein is also especially lightweight, and thereby enables a user such as a crossing guard or road worker, to easily and continuously hold the indicia warning oncoming drivers in an elevated position. In this fashion, the warning can be much more easily seen by oncoming drivers, as well as trailing drivers to a lead driver in front of them, who are approaching a crosswalk.

Additionally, the device herein provides multiple planar panels when deployed, of a size having positioning of the panels where indicia is placed thereon, to be more easily read from a distance. While sufficiently large during use, the device herein collapses to an easily stored configuration, to allow it to be stowed easily in a backpack, carried bag, or purse or the like, to encourage ongoing and subsequent use by rendering it handy when needed.

It should be noted, the foregoing examples of related art in warning signs for road-crossing pedestrians and workers, and limitations related therewith are intended to be illustrative and not exclusive, and they do not imply any limitations on the device and system described and claimed herein. Various limitations of the related art are already known or will become apparent to those skilled in the art upon a reading and understanding of the specification below and the accompanying drawings.

An object of the present invention is the provision of a warning sign employable to warn oncoming drivers they are approaching a pedestrian crosswalk, which is configured with a deployed size having easily readable indicia and a collapsed size rendering it easily stored.

It is another object of the invention to provide such a sign which is very lightweight to encourage use in an elevated position to thereby provide enhanced viewing at a distance to warn oncoming drivers earlier in their approach.

Yet a further object of this invention is the provision of such a collapsible warning sign for oncoming drivers, which includes one or both of indicia which is enhanced for viewing, and/or surrounding material which may be reflective or otherwise contrast enhanced with the lettering.

Further objectives of the disclosed invention herein will be brought out in the following parts of the specification wherein the summary and detailed description of the invention are for the purpose of fully disclosing the invention without placing limitations thereon.

SUMMARY OF THE INVENTION

The present invention provides a solution to the noted shortcomings in the art for driver-discernible warning signs alerting them to their approach to a pedestrian walkway or roadway work site. The device is configured with a frame and cover formed of materials to ensure it is lightweight. It is therefore more easily held elevated for long durations which might occur where a crossing guard is escorting children or adults crossing a street to reach school or an event, or where road workers are working inches from a car lane.

The device includes a lightweight collapsible frame, formed of lightweight material such as aluminum, fiberglass, carbon fiber, or similar materials adapted to form strong but flexible lightweight supports which will collapse and extend. The frame is formed of a plurality of hinged members extending from a center support, all of which will rotate and expand to a deployed configuration. In this deployed configuration, a fabric cover is pulled and held taught. The frame is easily collapsed to allow the frame and cover to be compactly stowed.

In the deployed configuration, a telescopic support pole can be elongated from the stored configuration, and elongated to a length which is a multiple of the length of the individual segments forming the pole. Currently, a pole having a length between 24 to 48 inches from the handle end to the collapsible fabric supports is preferred. Individual segments of approximately 12-16 inches can be engaged in a telescoping engagement for the support pole. In this fashion, they will translate to expand to a deployed length and subsequently translate onto themselves to a collapsed length of substantially a single segment.

At a distal end of the telescopic pole, opposite the handle end, is positioned a folding framework which moves from a stored configuration where the rotationally engaged members of the framework abut each other substantially parallel to the support pole, to a deployed configuration where the support members are normal to the axis of the support pole, and where they form a framework which stretches and holds a fabric cover taught. A disengageable lock positioned on the centrally located support pole, once moved to a disengaged position, allows the user to move the segments of the pole from the deployed configuration to an overlapping collapsed position. Concurrently, the framework will rotate in the engagements to the support pole and will move back to the stored configuration.

This deployable framework is configured to position a plurality of side panels, to taught planar configurations surrounding a perimeter of the deployed framework. Currently, four planar side panels are a preferred number in that it provides vertically deployed side panels facing four different directions. This configuration also allows the user to position two of the side panels parallel to the lines of a crosswalk easily, and thereby ensure that drivers approaching from both directions will be able to see the indicia positioned on one of the two opposing side panels. Optionally, the other two side panels can have indicia thereon, which would face the pedestrians on either side of the street and provide them with direction as to whether to cross or not.

In one preferred mode of the device, the indicia is formed by ink which is phosphorescent and/or reflective. This allows the word formed by the indicia, such as "stop" or "slow" or the like, to be more easily read by approaching drivers who view the elevated device and planar side panels having the indicia thereon.

Additionally, the fabric forming the cover to the framework and the side panels for the indicia can be formed of reflective material, such that headlights hitting the cover will reflect back toward approaching drivers. Such will provide a particularly effective warning to drivers at dusk or in the evening when headlights are illuminated.

Further, the plurality of planar panels, can be formed to be easily removed and replaced with another plurality of planar fabric panels. This allows the user to reconfigure the device, and attach any plurality of panels bearing indicia of choice, from a kit of such planar panels. Currently ease of engagement is provided by a plurality of hinged connections between the fabric panels, and the framework, which are easily engaged, removed, and re engaged, to allow the user a quick and easy means to change the personalized message of the indicia and/or the color thereof or of the panels using one of a set of panels from a kit thereof, to the appropriate color, background or user-desired message for the anticipated use of the device.

With respect to the above description, before explaining at least one preferred embodiment of the herein disclosed collapsible pedestrian warning device in detail, it is to be understood that the invention is not limited in its application to the details of construction and to the arrangement in the following description or illustrated in the drawings. The sign herein described is capable of other embodiments and of being practiced and carried out in various ways which will become obvious to those skilled in the art upon reading this disclosure. Also, it is to be understood that the phraseology and terminology employed herein are for the purpose of description and should not be regarded as limiting.

As such, those skilled in the art will appreciate that the conception upon which this disclosure is based, may readily be utilized as a basis for the designing of other easily deployed collapsible warning systems and devices, and for carrying out the several purposes of the present disclosed system. It is important, therefore, that the claims herein be regarded as including such equivalent construction and methodology, insofar as they do not depart from the spirit and scope of the present invention.

BRIEF DESCRIPTION OF DRAWING FIGURES

The accompanying drawings, which are incorporated herein and form a part of the specification, illustrate some, but not the only or exclusive examples of embodiments and/or features of the invention. It is intended that the embodiments and figures disclosed herein are to be considered illustrative rather than limiting. In the drawings.

Figure 1:
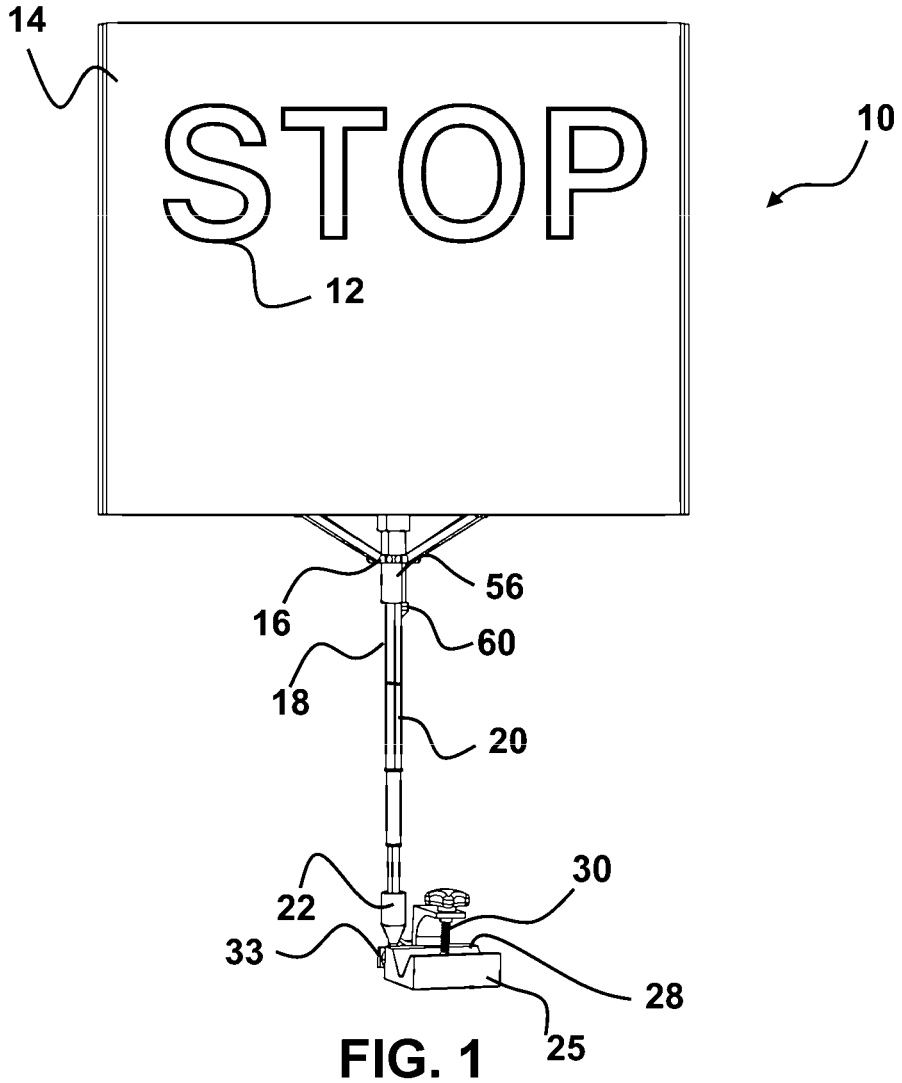
FIG. 1 is a depiction of a preferred mode of the device herein, showing it in a deployed configuration where it would be viewed by an approaching driver, where an underlying framework holds the planar portions of a fabric cover having four side panels vertically disposed with indicia thereon.

The figures so depicted, are not intended to be exhaustive or to limit the collapsible sign invention to the precise form of the device and method disclosed herein or the configuration, color, indicia or venue for use thereof. It should be understood that the invention can be practiced with modification and alteration, and that the disclosed technology shall be limited only by the claims and any equivalents thereof as would occur to those skilled in the art.

DETAILED DESCRIPTION OF THE PREFERRED EMBODIMENTS OF THE INVENTION

The following description is not to be taken in a limiting sense, but is made merely for the purpose of describing the general principles of the disclosed embodiments of the collapsible sign device herein. The present embodiments address the problems described in the background while also addressing other additional problems as will be seen from the following detailed description. Numerous specific details are set forth to provide a full understanding of various aspects of the subject disclosure herein. It will be apparent, however, to one ordinarily skilled in the art, that various aspects of the subject disclosure may be practiced without some of these specific details. In other instances, well-known structures and techniques have not been shown in detail to avoid unnecessarily obscuring the subject disclosure.

In addition, in this description, any directional prepositions if employed, such as up, upwardly, down, downwardly, front, back, first, second, top, upper, bottom, lower, left, right and other such terms referring to the device or depictions as such may be oriented, are describing it such as it appears in the drawings and are used for convenience only. Such terms of direction and location are not intended to be limiting or to imply that the device herein has to be used or positioned in any particular orientation.

Now referring to drawings in FIGS. 1-7 herein, wherein similar components are identified by like reference numerals, there is seen in FIG. 1 a preferred mode of the collapsible sign device 10 shown in a deployed configuration. As seen in FIG. 1, the indicia 12 is clearly visible on the taught but flexible panel 14 which has been drawn taught by the positioning of the frame 16, to a deployed or expanded configuration which is also shown in FIG. 1.

Also shown for example in FIGS. 1-4, a telescopic pole 18 extends from the frame 16 in this deployed configuration. The pole 18 is formed of a plurality of telescopically engaged pole segments 20 which lock into an expanded configuration and will translate back to a retracted position of the device shown in the example in FIG. 7.

At a distal end of the pole 18 is positioned a handle 22 which is adapted for gripping by a user. To enhance the grip of the user on the handle a ball 24 as show in FIG. 7 has a recess 26 adjacent thereto. This recess 26 defines a recessed grip area which helps maintain the grip of the user in slippery or windy conditions, because the ball 24 will not slip through the hand easily where part of the hand is in the recess 26. It was found that forming the recess 26 in a diameter from 30-70 percent of the diameter of the ball 24 provided the best grip to the user which avoided the handle from slipping from their grasp such as in high wind conditions.

While it is envisioned, the primary use of the device 10 will be hand held, accommodations are made for either storage and for the device 10 to be held in place. As shown in FIG. 1, a mount 25 can be optionally provided. The mount is configured to be compressively engageable to a rod or pole or part of a frame, within a slot 28 in the mount. This removable engagement is maintained once a screw 30 is tightened to hold a rod compressed in the slot 28, such as a rod for a folding chair or the like.

The optional mount 25 has a cavity 33 adapted to rotationally engage with the ball 24 when the handle 22 is not being held in the hand. The cavity 33 is configured to frictionally engage with the ball 24 and only allow rotation therein under force. This allows the ball 24 to be engaged maintained in position, which will maintain the pole 18 in position and angle until moved by the user imparting force against the pole 18 to change the angle.

Figure 2:
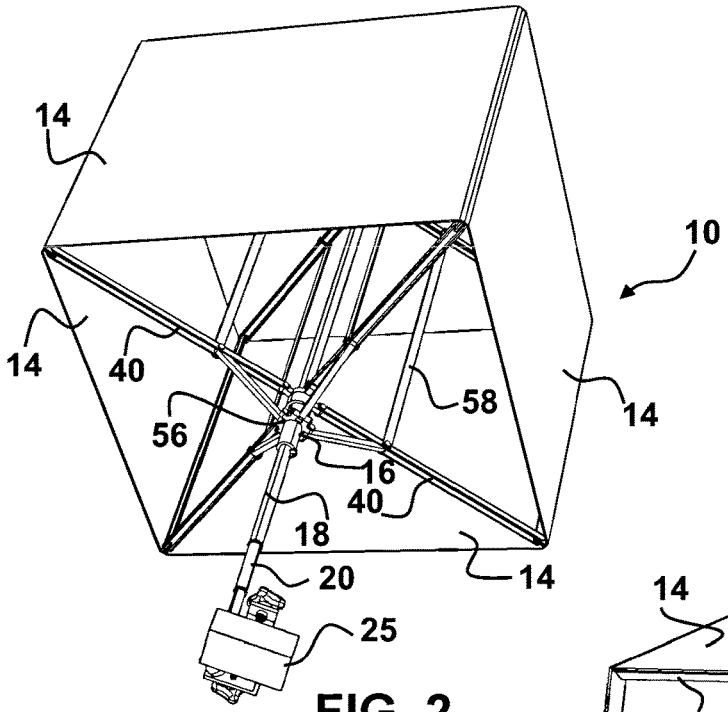
FIG. 2 shows a perspective view from a lower edge of the device of FIG. 1, showing the internal framework slidably and rotationally engaged upon the central support member.
Figure 5:
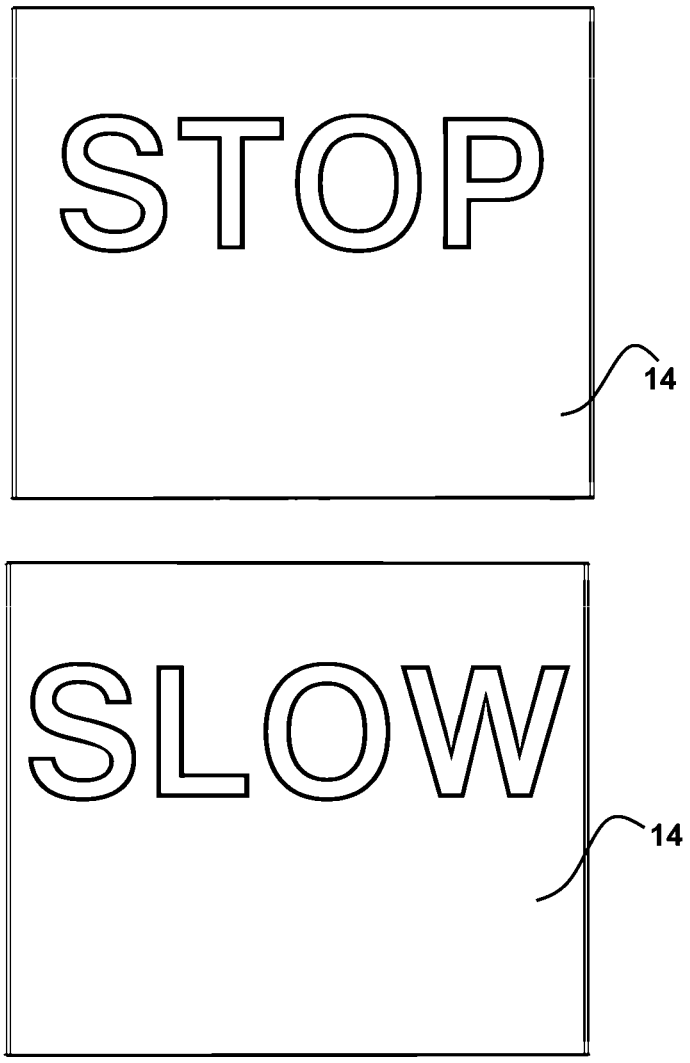
FIG. 5 depicts a kit of planar fabric panels, which could have two or dozens of engageable panels, which as noted above could be formed of individual panels, or panels formed in a tube like configuration, with differing colors and indicia allowing the user to choose any from the kit for engagement to the device.

Shown in FIG. 2, is a perspective view from a lower edge of the device 10 from that of FIG. 1, where the frame 16 can be surrounded by the four panels 14 any or all of which may bear any indicia 12 chosen by the user. As noted, the indicia 12 is positioned on the engageable panels 14 and multiple engageable panels 14 with different indicia 12 that can be provided in a kit of panels 14 such as shown in FIG. 5, to allow the user to change the message to an appropriate one to the intended use. This allows the device 10 to be changed to an infinite number of possible messages where a kit such as that of FIG. 5, has a plurality of any number of panels 14 bearing indicia 12 providing any number of letters or pictures or other indicia 12. The indicia can be any type of word or alphanumeric symbol or drawing or figure appropriate to the intended use of the device 10 such as for a sporting event, party, warning sign, concert, political event, or any other venue or event where signage on a portable collapsible device could be used. The panels 14 and the indicia 12 can be any color or color combination. Further, the panels 14 for the device 10 may also have personalized messages created by users, to read for example as CAL FAN, Go Bears, etc. in blue and gold using a separate panel kit and numbers, letters, shapes, etc. Using hook and loop fabric on the panels and the available indicia 12 in a kit, the message and symbols on a panel 14 in the kit may be customized by users also.

Figure 3:
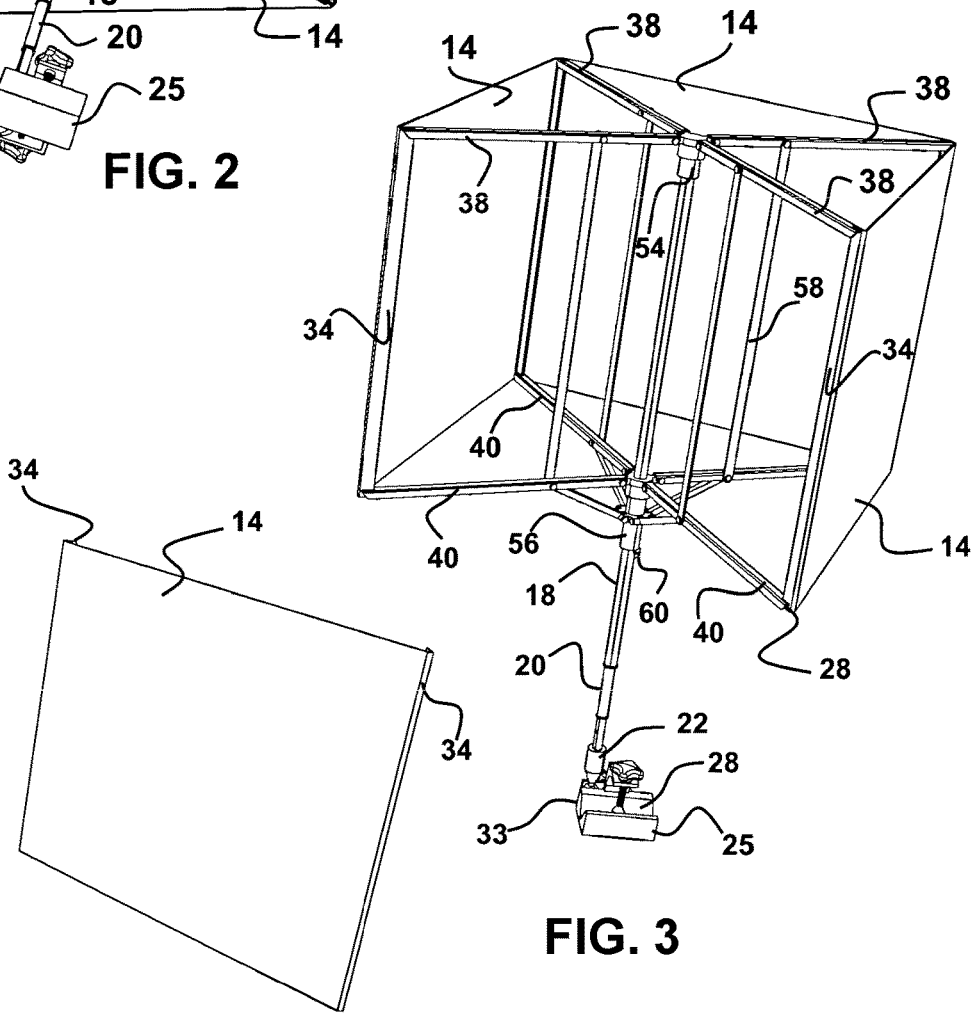
FIG. 3 shows the device as in FIGS. 1 and 2 showing a removably engageable planar fabric panel.
Figure 4:
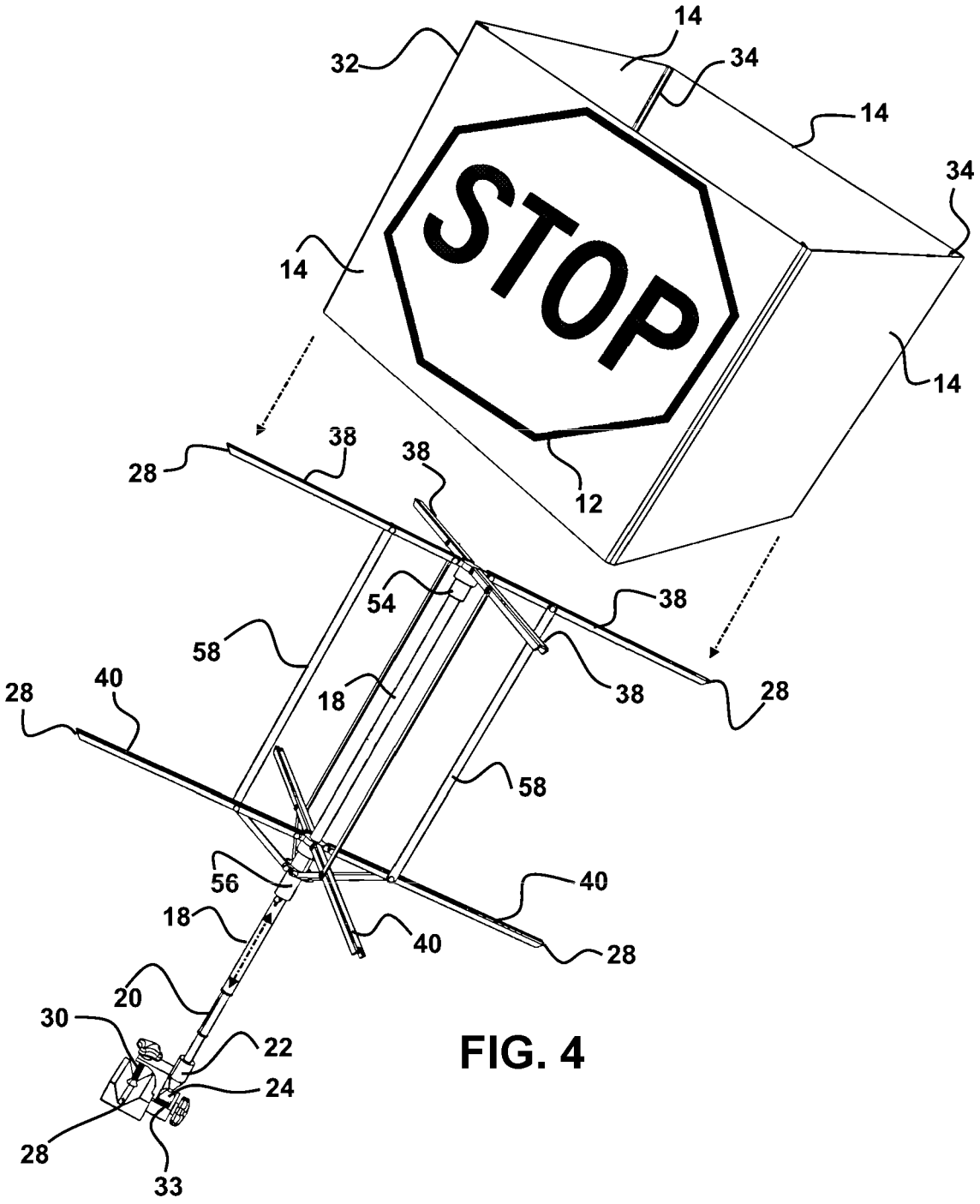
FIG. 4 shows an exploded view of a mode of the device of FIG. 1, where the four planar fabric sides are formed in a tube like structure having a plurality of ribs which are rotationally engageable to horizontal support members using a connector such as a pin or lace or zip tie.

As shown in FIGS. 2-4, the panels 14, can be formed in singular panels 14, or can be formed in a plurality panels 14 formed to a single engageable cover as in FIG. 4. Whether formed to individual panels 14, or to an engageable cover 32 formed of a plurality of panels 14 such as four panels 14, in all modes of the device 10 it is preferred that the panels 14 engaged the frame 16 through the engagement of fabric ribs 34 formed on and positioned on opposing side edges of each panel 14 or plurality of panels 14 forming a cover 32. The ribs 34 can be formed for example by folding layers of fabric forming the panel 14 and sewing such, or sewing on fabric reinforcement strips onto the panels 14 at opposing ends. This will form the ribs 34 stronger than the flexible fabric forming the rest of the panel 14 to better handle the stress of holding the panel 14 to a frame 16 in wind.

Figure 6:
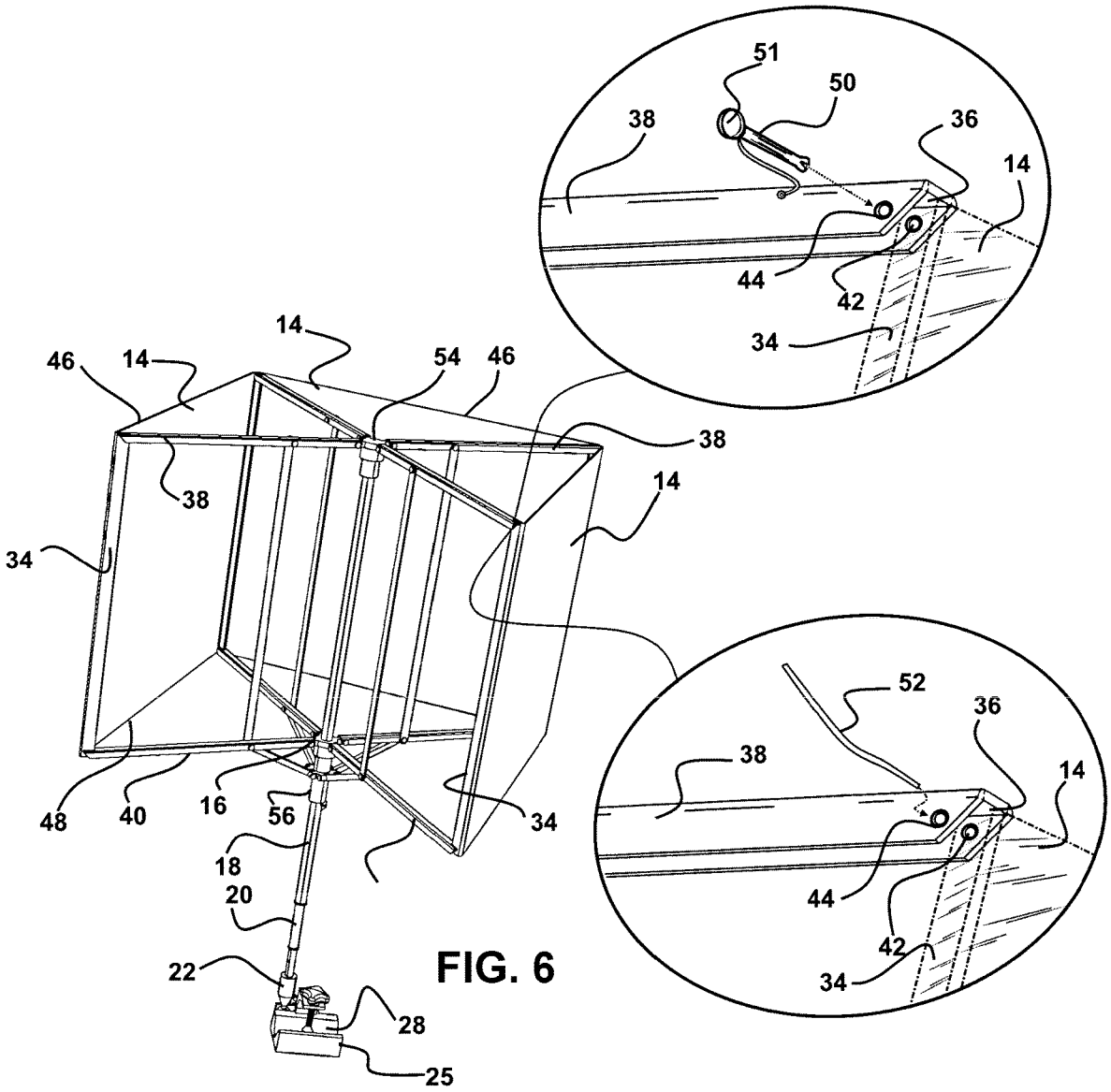
FIG. 6 shows the device of FIGS. 1-4, and showing enlarged views of the rotational engagement of hemmed or ribbed portions, in rotational engagements with slots formed at the distal ends of parallel aligned horizontal support members.

As shown in FIG. 6, each rib 34 on each opposing side of each panel 14, is sized to slide into a slot 36 depending into opposing aligned upper horizontal members 38 and depending into opposing lower aligned horizontal members 40. Thus, the rib 34 formed along opposing sides of each respective panel 14, between the top edge 46 and bottom edge 48, are sized to extend a length where openings 42 communicating through the rib 34 adjacent the top edge 46 and bottom edge 48 of each panel 14, align with apertures 44 formed into the upper horizontal members 38 and lower horizontal members 40, where those apertures 44 are on opposing sides of each slot 28.

As can be seen, the slots 28 are formed at each of the distal ends of each respective upper horizontal member 38 and lower horizontal members 40. The distance between each pair of openings 42 formed at or adjacent an opposing end of each rib 34, is at least equal too, or more preferably, slightly less, than a distance between apertures 44 in the opposing slots 28 of each pair of aligned upper horizontal member 38 and lower horizontal member 40. Forming the distance slightly less, imparts a stretching to the rib 34 which helps maintain the planar portion of the panel 14, taught also.

Each opening 42 is held in a rotational engagement when engaged with the apertures 44 formed in each respective slot 28. A connector such as a pin connector 50 or a tie connector 52 such as a string or zip tie or the like, is removably engageable by insertion through apertures 42 in a slot 28 and the opening 42 adjacent thereto, to form such a rotational engagement. It is preferred this engagement of openings 42 to the respective slots 28 be rotational, as it has been found in experimentation that the fabric moves between the loose configuration when in the collapsed configuration of FIG. 7 to the taught configuration of FIGS. 1-2, more easily and does not bind up, and imparts less wear and tear to the panels 14 over time. In one mode, the pin connector 50 is provided tethered to the upper or lower horizontal member 40 which it engages, and includes a ring 51 configured to surround a finger of a user to allow easier removal and re engagement when changing or replacing panels 14 or covers 32.

An example of a cover 32 is shown in FIG. 4. The cover 34 is formed of a plurality such as four panels 14, having their respective ribs 34 connected to form a tube like cover 34. Engagement is the same as in FIG. 6, wherein openings 42 formed at opposite ends of the engaged ribs 34, are connected to apertures 44 on opposing slots 36 formed in aligned lower horizontal members 40 and upper horizontal members 38. In this mode of the device 10 the kit of panels 14 such as shown in FIG. 5, are formed of engaged panels 14 forming a plurality of covers 32 each having different indicia 12 thereon to match the intended use.

As shown in FIG. 4 and FIG. 6, the frame 16 is positioned on the pole 18 and has a first end of each of the upper horizontal members 38 rotationally engaged to an upper mount 54 and first ends of each of the lower horizontal members 40 rotationally engaged to a lower mount 56 which holds the device 10 in the deployed or expanded position of FIG. 1, when held by a lock 60 such as a depressible button on the pole 18. To move the frame 16 to a collapsed position, the lock 60 is disengaged by, for example, depressing the spring loaded button, and a translation of the lower mount 56 in its slidable engagement on the pole 18 in a direction toward the handle 22, will cause struts 58 rotationally connected at a first end to a lower horizontal member 40 to pull upon and rotate the upper horizontal member 38, which is rotationally connected to the opposite end of the strut 58.

Figure 7:
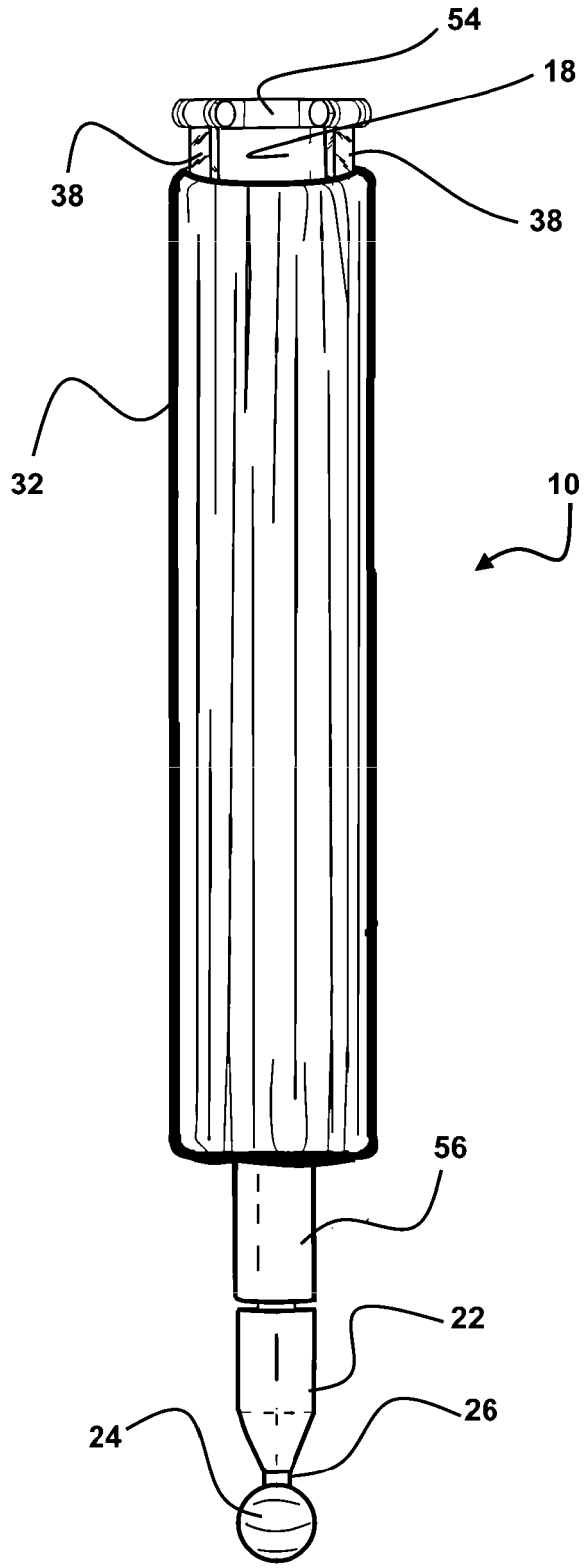
FIG. 7 shows the device such as in FIG. 1, in a collapsed configuration wherein the telescopic central support is collapsed causing the horizontal supports to rotate downward and bringing the fabric panels to a collapsed state surrounding them, and showing the handle having a ball at one end extending therefrom.

In this configuration, a translation of the lower mount 56, in its sliding engagement on the pole 18, will cause all of the upper horizontal members 38, and lower horizontal members 40, to rotate at respective first end engagements, and move to collapsed positions substantially aligned with the pole 18, and adjacent it. This configuration is shown in the illustration of FIG. 7, where the segments 20 of the pole 18 have been translated over each other, and the lower mount 56 is positioned adjacent the handle 22, and the cover 32 formed of a plurality of panels 14 has been collapsed.

In some modes of the device 10 the panels 14 individually or formed to a cover 32, may have indicia 12 formed of reflective and/or phosphorescent material. Alternatively or in combination, the flexible textile, woven, or non woven fabric material forming the panels 14, may have reflective or phosphorescent qualities. The indicia 12 may be printed with ink, paint or the like, or applique with fabric which is reflective or phosphorescent, or both. It should be noted that the device 10 may be illuminated by positioning light emitters on the interior of the panels 14, which can be connected to an onboard battery to provide a glowing cover 12 from backlighting and highly contrasted indicia 20.

Lastly, as noted above, while not depicted in the drawings, the device 10 can come in configurations which are illuminated such as by LED light emitters engaged to the components forming the frame 16 to back-light the panels 14 or cover 32, to make it much more visible at night. The lighting could also be switchable to blink or otherwise provide colored or other lighting characteristics appropriate to the event or venue where it is to be employed, which will gain the attention of oncoming drivers.

While all of the fundamental characteristics and features of a collapsible and customizable sign system herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that upon reading this disclosure and becoming aware of the disclosed novel and useful device and system herein disclosed, that various substitutions, modifications, and variations may occur to and be made by those skilled in the art, without departing from the spirit or scope of the invention. Consequently, all such modifications and variations and substitutions, as would occur to those skilled in the art are considered included within the scope of the invention as defined by the following claims.

What is claimed is:

1. A collapsible user customizable sign comprising:

a frame, said frame having a collapsed position and having a deployed position;

said frame engaged to a first end of a pole, said pole extending to a handle on a second end;

said frame in said deployed position having a plurality of upper horizontal members each rotationally connected at a first end with said pole, each of said upper horizontal members extending a distance away from said pole to a respective distal end;

said frame having in said deployed position having a plurality of lower horizontal members each rotationally connected at a first end with said pole, each of said lower horizontal members extending said distance from said pole to a respective distal end;

each of said upper horizontal members being aligned with one of said lower horizontal members;

slots depending into each said upper horizontal member at each respective said distal end thereof;

slots depending into each said lower horizontal member at each respective said distal end thereof;

a plurality of flexible panels extending between a first side edge to a second side edge;

each of said flexible panels having flexible fabric ribs extending along said first side edge and said second side edge of each of said flexible panels;

each of said panels engageable with said frame with a rotational engagement of opposing ends of each of said fabric ribs, with a respective distal end of a said upper horizontal member and a lower said horizontal member;

said a rotational engagement of said opposing ends of each of said fabric ribs being a folded positioning of each of said first side edge and said second side edge around a respective distal end of a said upper horizontal member and a said lower horizontal member locating said opposing ends of each of said fabric ribs into a respective said rotational engagement, within a respective said slot; and indicia positioned on some or all of said panels.

2. The collapsible user customizable sign of claim 1, additionally comprising:

pins tethered to said frame; and said pins removably engageable with each respective said rotational engagement of said opposing ends of each of said fabric ribs located within a respective said slot.

3. The collapsible user customizable sign of claim 2, additionally comprising:

a first end of said handle being connected to said second end of said pole;

a ball formed at a second end of said handle;

a recess depending into said handle adjacent said ball; and said recess defining a recessed grip point adapted for contact by a gripping hand of a user to position said ball as a barrier for said handle sliding from said contact by said gripping hand.

4. The collapsible user customizable sign of claim 3, additionally comprising:

said plurality of flexible panels each being a member of a kit of removably engageable panels; and each said member of said kit of removably engageable panels having different indicia thereon or having a different color of said panel.

5. The collapsible user customizable sign of claim 2, additionally comprising:

said plurality of flexible panels each being a member of a kit of removably engageable panels; and each said member of said kit of removably engageable panels having different indicia thereon or having a different color of said panel.

6. The collapsible user customizable sign of claim 1, additionally comprising:

a first end of said handle being connected to said second end of said pole;

a ball formed at a second end of said handle;

a recess depending into said handle adjacent said ball; and said recess defining a recessed grip point adapted for contact by a gripping hand of a user to position said ball as a barrier for said handle sliding from said contact by said gripping hand.

7. The collapsible user customizable sign of claim 6, additionally comprising:

said plurality of flexible panels each being a member of a kit of removably engageable panels; and each said member of said kit of removably engageable panels having different indicia thereon or having a different color of said panel.

8. The collapsible user customizable sign of claim 1, additionally comprising:

said plurality of flexible panels each being a member of a kit of removably engageable panels; and each said member of said kit of removably engageable panels having different indicia thereon or having a different color of said panel.

* * * * *